US007686602B1

(12) United States Patent
Landhuis

(10) Patent No.: US 7,686,602 B1
(45) Date of Patent: Mar. 30, 2010

(54) SLIPPERS FOR ROLLERS IN A ROLLER VANE PUMP

(75) Inventor: Kevin J. Landhuis, Ankeny, IA (US)

(73) Assignee: Sauer Danfoss Inc., Ames, IA (US)

( * ) Notice: Subject to any disclaimer, the term of this patent is extended or adjusted under 35 U.S.C. 154(b) by 857 days.

(21) Appl. No.: 10/787,802

(22) Filed: Feb. 26, 2004

(51) Int. Cl.
*F01C 1/00* (2006.01)
*F03C 2/00* (2006.01)

(52) U.S. Cl. ..... 418/225; 418/152; 418/178; 418/179

(58) Field of Classification Search ..... 418/225, 418/75, 82, 152, 178, 179
See application file for complete search history.

(56) References Cited

U.S. PATENT DOCUMENTS 2,117,573 A 5/1938 Rawls
3,138,112 A * 6/1964 Porta et al. ..... 417/270
3,511,131 A 5/1970 Kress
4,896,633 A 1/1990 Junghans et al.
4,915,592 A * 4/1990 Hishinuma et al. ..... 417/206
4,932,510 A * 6/1990 Takemura et al. ..... 475/84
5,030,071 A 7/1991 Simpson
6,398,528 B1 6/2002 Hansen et al.

FOREIGN PATENT DOCUMENTS

SU 1359484 * 12/1987

* cited by examiner

*Primary Examiner*—Theresa Trieu

(57) ABSTRACT

A roller vane pump that uses slippers on its rollers to create multiple seals. The roller vane pump has a fixed cam ring that has a rotor within. The rotor has openings that receive rollers that rotate about the inside of the cam ring. Each roller has a slipper rotatably connected thereto. The use of the slipper allows multiple seals to be created between the slipper, the rollers, and the cam ring and additionally allows for the roller vane pump to rotate clockwise or counterclockwise without the changing of parts.

11 Claims, 1 Drawing Sheet

SLIPPERS FOR ROLLERS IN A ROLLER VANE PUMP

BACKGROUND OF THE INVENTION

A roller vane pump has rollers that fit into openings within a rotor. As the rotor rotates it drives the rollers around the inside of a non-rotating cam ring. The rollers roll on the inside of the cam ring and will slide on the rotor face, or the roller will be fixed against the rotor face and will slide against the cam ring. Then the surface that has the lowest coefficient of friction will be the surface on which sliding will occur.

The pump is ported through a port plate under the rollers to allow hydraulic fluid to flow into and out of the pump. The rotor center line is offset from the cam ring center line to create two volumes, one that is expanding in the direction of rotation and one that is contracting in the direction of rotation. The expanding volume is the inlet/low pressure side and the contracting volume is the outlet/high pressure side. Two transition zones exist that are not ported to either the high pressure or low pressure side. The rollers act as seals in the transition zone between the high pressure and low pressure chambers to prevent fluid transfer from high pressure to low pressure. There is always some point in the pump where transition occurs between high pressure and low pressure. In the transition zone the roller is loaded by high pressure against the rotor face and against the inside of the cam ring. The relatively small radius of the roller against the larger radius of the cam ring or the flat face of the rotor causes high compressive stress when the roller is pressure loaded in the transition zone.

There are two types of transitions, the first is transition from high pressure to low pressure. In this area the roller is loaded against the trailing side of the rotor face. In the second transition, or the low pressure to high pressure transition, the roller is loaded against the leading rotor face.

One problem with this system is that the sliding that occurs between the roller and the rotor, or cam ring, at high rotation speeds, when added to a high compressive load, limits the operating speed and pressure for the roller vane pump. Consequently, if higher speeds and pressures are attempted, wear occurs between the roller and the cam ring, or between the roller and the rotor face. This results in wear and limits the pump life, and effects pump efficiency.

Because of the problems in the art, there is a need in the art to have a roller vane pump that maintains a low coefficient of friction between the rotor and the roller and a higher coefficient of friction between the roller and the inside of the cam ring. There is also a need to reduce the amount of wear on a roller vane pump. There is a need in the art to provide a roller vane pump that will protect an advancing and trailing rotor face, thus it will be able to rotate clockwise and counterclockwise using the same roller and rotor components.

Therefore, it is a primary object of the present invention to provide a roller vane pump that maintains a low coefficient of friction between the rotor and roller by introducing a slipper as an intermediator, and high coefficient of friction between the roller and the inside of the cam ring.

A further object of the present invention is to provide a roller vane pump that reduces the wear of the pump when it is operated at high speeds causing the pump to have a longer life and improved efficiency.

Yet a further object of the present invention is to provide a roller vane pump designed that uses a roller with a slipper that will protect the advancing and trailing rotor face.

Another object of the present invention is to protect the advancing and trailing rotor face by having a design that can be used with clockwise and counterclockwise rotation using the same slipper, roller, and rotor components.

These and other objects, features, or advantages of the present invention will become apparent from the specification and claims.

BRIEF SUMMARY OF THE INVENTION

The present invention is a roller vane pump that uses slippers that cover more than 180 degrees of the roller and less than 360 degrees of the roller to provide a seal against the rotor of the roller vane pump. The roller vane pump has a cam ring and rollers that fit within openings within the rotor. The rollers rotate around the inside of the fixed cam ring. The slipper, by covering a portion of the rollers, helps create a seal between the roller and the rotor. Thus, greater roller vane pump life and efficiency occurs.

DESCRIPTION OF THE PREFERRED EMBODIMENTS OF THE INVENTION

Figure 1:
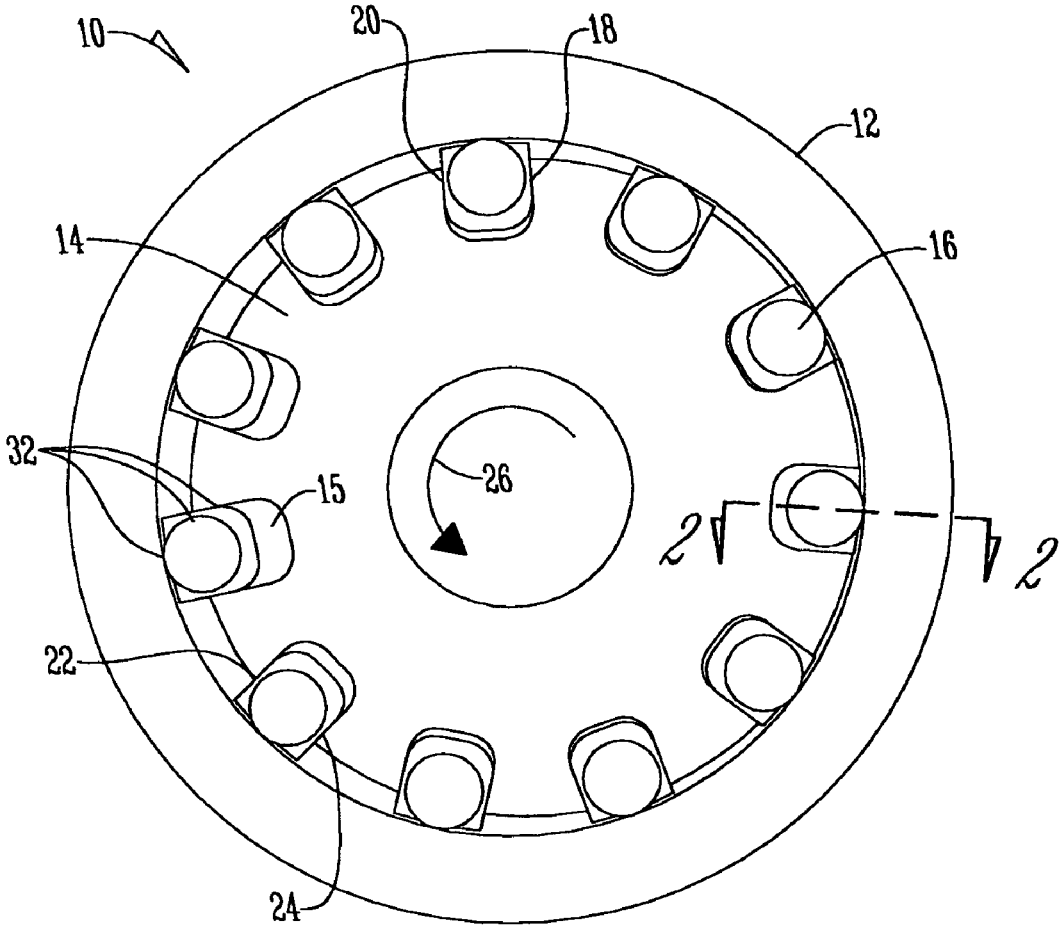
FIG. 1 is a schematic of the roller vane pump of the present invention.
Figure 2:
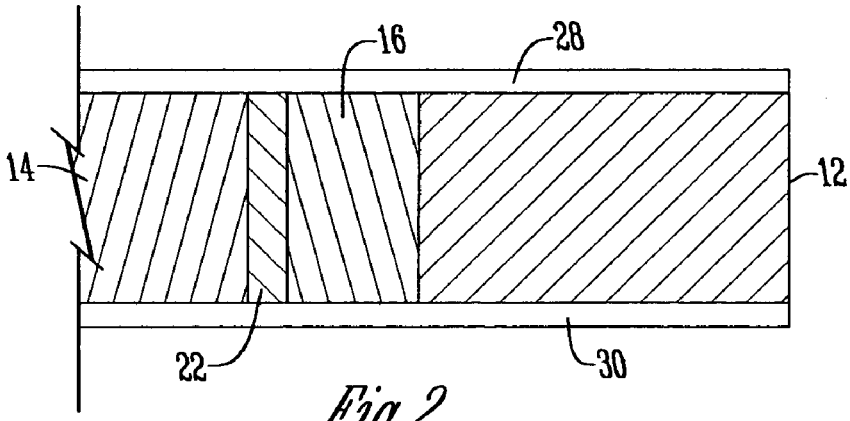
FIG. 2 is a cross section of the roller vane pump taken along line 2-2 in FIG. 1.

FIG. 1 shows a roller vane pump 10 that has an outer cam ring 12 with inner and outer surfaces and an inner rotor 14. The rotor 14 has a plurality of spaced apart openings 15 adjacent the inner surface of the cam ring 12 that receive a plurality of elongated cylindrical rollers 16. The spaced apart openings 15 in the rotor 14 create a leading rotor face 18 and a trailing rotor face 20 which are dependent on the direction of rotor rotation. Rotatably around each roller 16 is a slipper element 22 having a front, back, and top side that creates a plurality of seals 24 between the roller 16, the face of the rotor 14 and the slipper 22 itself. In FIG. 1 the rotation 26 of the rotor 14 is counterclockwise. FIG. 2 shows a sectional view of the roller vane pump 10 and additionally shows cover 28 and port plate 30 that is fluidly connected to the roller vane pump 10.

In operation, the rollers 16 will always roll against the inside of cam ring 12 so no sliding will occur between the roller 16 and the cam ring 12. The pressure load on the slipper 22 is distributed against the roller 16 and against the face of rotor 14 so that contact stress is low. Thus, the slipper 22 distributes the pressure load on the face of the rotor 14 in both high pressure to low pressure transition zones and in low pressure to high pressure transition zones. Each slipper 22 will contact either a leading rotor face 18 or a trailing rotor face 20 when in the pressure transition zones. Additionally, in the transition zones high pressure will force a plurality of seals 32 between the roller 16 and the cam ring 12, between the slipper 22 and the roller 16, and between the slipper 22 and the rotor 14.

It should be appreciated that the slipper 22 supports less than 360 degrees of the roller 16 so that the roller 16 still contacts the inside of the cam ring 12 but supports more than 180 degrees of the roller 16 so that the roller 16 will not contact the leading rotor face 18 or the trailing rotor face 20. Consequently, the roller 16 is contained within the slipper 22. The inside diameter of the slipper 22 closely matches the outside diameter of roller 16. Furthermore, the slipper 22 is designed with a low coefficient of friction so that the roller 16 will rotate against the inside of the cam ring 12 and will slide inside the slipper 22.

Because of this design, the roller vane pump 10 is able to maintain a low coefficient of friction between the slipper 22 and the roller 16 and a higher coefficient of friction between the roller 16 and the inside of cam ring 12. By ensuring that the roller 16 is rolling on the inside of the cam ring 12, the pump 10 will operate at higher speeds and pressures with less wear, resulting in longer pump life and improved pump efficiency. Furthermore, the roller vane pump 10 design protects the leading rotor face 18 and the trailing rotor face 20, thus allowing for clockwise and counterclockwise rotation using the same slipper 22, roller 16, and rotor components. Consequently, all of the objectives of the present have been met.

It will be appreciated by those skilled in the art that other various modifications could be made to the device without the parting from the spirit in scope of this invention. All such modifications and changes fall within the scope of the claims and are intended to be covered thereby.

What is claimed is:

1. A roller vane pump having a cam ring having inner and outer surfaces comprising:

a rotor having a face with a center opening and a plurality of spaced apart openings adjacent the inner surface of the cam ring;

at least one slipper element partially and slidably surrounding a roller, wherein the slipper surrounds at least 180 degrees of the roller;

wherein only the slipper element and the roller are positioned within the spaced apart opening to distribute a pressure load on the rotor face and wherein the coefficient of friction between the slipper and the roller is less than the coefficient of friction between the roller and the cam ring so that the roller rotates against the cam ring.

2. The roller vane pump of claim 1 wherein the slipper surrounds less than 360 degrees of the roller.

3. The roller vane pump of claim 1 wherein the slipper creates a fluid seal between the rotor and the cam ring under conditions of high fluid pressure.

4. The roller vane pump of claim 1 wherein a fluid seal is created between the slipper element and the roller under conditions of high fluid pressure.

5. The roller vane pump of claim 1 wherein a fluid seal is created between the slipper element and the rotor under conditions of high fluid pressure.

6. The roller vane pump of claim 1 wherein the slipper element has a front surface engaging an advancing rotor face element and a back surface engaging a trailing rotor face element such that the slipper creates a fluid seal between the roller and the advancing and trailing rotor face elements.

7. The roller vane pump of claim 6 wherein the fluid seal created between the roller and the advancing and trailing rotor face elements allows the rotor to rotate clockwise and counterclockwise.

8. A roller vane pump having a fixed cam ring, a rotor having a rotor face, and elongated cylindrical rollers within the rotor, the improvement comprising:

at least one elongated slipper element having a front, back, and top partially and slidably surrounding an elongated cylindrical body of a roller to distribute a pressure load on the rotor face; wherein only the slipper element and roller distribute a pressure load on the rotor face, and wherein the coefficient of friction between the slipper and the roller is less than the coefficient of friction between the roller and the cam ring so that the roller rotates against the cam ring.

9. The roller vane pump of claim 8 wherein the slipper surrounds less than 360 degrees of the roller.

10. The roller vane pump of claim 8 wherein the slipper creates a fluid seal between the roller and rotor face under conditions of high fluid pressure.

11. The roller vane pump of claim 8 wherein a fluid seal is created between the slipper and the rotor under conditions of high fluid pressure.

* * * * *